US007408300B2

(12) United States Patent
Kobayashi

(10) Patent No.: US 7,408,300 B2
(45) Date of Patent: Aug. 5, 2008

(54) ALTERNATING CURRENT DRIVEN TYPE PLASMA DISPLAY DEVICE AND PRODUCTION METHOD THEREFOR

(75) Inventor: Arata Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 516 days.

(21) Appl. No.: 11/050,728

(22) Filed: Feb. 7, 2005

(65) Prior Publication Data

US 2005/0275350 A1 Dec. 15, 2005

(30) Foreign Application Priority Data

Feb. 26, 2004 (JP) ..... 2004-050717

(51) Int. Cl.
*H01J 17/49* (2006.01)

(52) U.S. Cl. ..... 313/582; 313/586; 313/587

(58) Field of Classification Search ..... 313/582–587; 315/169.4

See application file for complete search history.

(56) References Cited

U.S. PATENT DOCUMENTS 5,888,591 A * 3/1999 Gleason et al. ..... 427/522
5,998,281 A * 12/1999 Aga et al. ..... 438/459
6,140,247 A * 10/2000 Muraoka et al. ..... 438/743
6,657,396 B2 * 12/2003 Nakada et al. ..... 315/169.1
2004/0157564 A1 * 8/2004 Murakami et al. ..... 455/76
2004/0197657 A1 10/2004 Spitler et al.

FOREIGN PATENT DOCUMENTS

JP 2000-21304 1/2000
JP 2000-294153 10/2000
JP 2002-42663 2/2002
JP 2003-059412 2/2003
JP 2003-92058 3/2003
JP 2003-132799 5/2003
JP 2004247068 A * 9/2004

* cited by examiner

*Primary Examiner*—Mariceli Santiago
*Assistant Examiner*—Donald L Raleigh
(74) *Attorney, Agent, or Firm*—Oblon, Spivak, McClelland, Maier & Neustadt, P.C.

(57) ABSTRACT

An alternating current driven type plasma display device which does not increase a driving voltage (discharge voltage) and does not increase a time delay of discharge is provided. The alternating current driven type plasma display device contains a first panel having a plurality of first electrodes formed on a first substrate and a dielectric layer formed on the first substrate and the first electrodes and a second panel, in which the first panel and the second panel are bonded to each other in circumferential portions thereof, the dielectric layer is constituted by $SiO_X$, and bonding density of $H_2O$ contained in $SiO_X$ is $3.0\times10^{20}$ Bonds/cm$^3$ or more.

4 Claims, 2 Drawing Sheets

ALTERNATING CURRENT DRIVEN TYPE PLASMA DISPLAY DEVICE AND PRODUCTION METHOD THEREFOR

BACKGROUND OF THE INVENTION

1. Field of the Invention

The present invention relates to an alternating current driven type plasma display device and a method for producing an alternating current driven type plasma display.

2. Description of the Related Art

As an image display device that can be substituted for a currently mainstream cathode ray tube (CRT), flat-screen (flat-panel) display devices are studied in various ways. Such flat-panel display devices include a liquid crystal display (LCD), an electroluminescence display (ELD) and a plasma display device (PDP). Of these, the plasma display device has advantages that it is relatively easy to form a larger screen and attain a wider viewing angle, that it has excellent durability against environmental factors such as temperatures, magnetism and vibrations, and that it has a long lifetime, and so on. The plasma display device is, therefore, expected to be applicable not only to a home-use wall-hung television set but also to a large-sized public information terminal.

In the plasma display device, a voltage is applied to discharge cells having discharge spaces charged with a discharge gas comprising a rare gas, and a fluorescence layer in each discharge cell is excited with a vacuum ultraviolet ray generated by glow discharge in the discharge gas, to thereby give light emission. That is, each discharge cell is driven according to a principle similar to that of a fluorescent lamp, and, generally, the discharge cells are put together on the order of hundreds of thousands to constitute a display screen. The plasma display device is largely classified either as a direct current driven type (DC type) or an alternating current driven type (AC type) according to methods of applying a voltage to the discharge cells. Each type has advantages and disadvantages. The alternating current driven type plasma display device (hereinafter, referred to also as "plasma display device") is suitable for attaining a higher fineness, since separation walls which work to separate the individual discharge cells within a display screen can be formed, for example, in the form of stripes. Further, it has an advantage that electrodes for discharge are less worn out and have a long lifetime since surfaces of the electrodes are covered with a dielectric layer comprising a dielectric material.

As an example of the plasma display device, a so-called tri-electrode type plasma display device is described, for example, in each of JP-A Nos. 5-307935 and 9-160525.

FIG. 1 shows a schematic exploded perspective view of a portion of a typical tri-electrode type plasma display device. In the plasma display device, discharge takes place between a pair of discharge sustaining electrodes 12. In the plasma display device shown in FIG. 1, a first panel 10, comprising a glass substrate, which corresponds to a front panel and a second panel 20, also comprising a glass substrate, which corresponds to a rear panel are bonded to each other in circumferential portions thereof by using frit glass (not shown) Light emission from fluorescence layers 25 on the second panel 20 is viewed, for example, through the first panel 10.

As shown in FIG. 1, the first panel 10 comprises a transparent first substrate 11; pairs of discharge sustaining electrodes 12, each comprising a transparent electrically conductive material such as ITO, formed on the first substrate 11 in the form of stripes (width being from approximately 80 μm to approximately 280 μm); bus electrodes 13, each comprising a material having a lower electric resistivity than the discharge sustaining electrode 12, formed on the discharge sustaining electrodes 12 for decreasing the impedance of the discharge sustaining electrode 12; a dielectric layer 14 formed on the first substrate 11 as well as on the bus electrodes 13 and discharge sustaining electrodes 12; and a protective film 15, comprising MgO, formed on the dielectric layer 14. A discharge gap G between a pair of the discharge sustaining electrodes 12 is preferably in the range of from $5\times10^{-6}$ m to $1.5\times10^{-4}$ m and, particularly preferably, less than $5\times10^{-5}$ m.

On the other hand, the second panel 20 comprises a second substrate 21; a plurality of address electrodes (also called as data electrodes) 22 formed on the second substrate 21 in the form of stripes; a dielectric material layer 23 formed on the second substrate 21 as well as on the address electrodes 22; insulating separation walls 24, extending in parallel with the address electrodes 22, which are each formed in a region between adjacent address electrodes 22 on the dielectric material layer 23; and fluorescence layers 25 provided on the dielectric material layer 23 and extending to faces of side walls of the separation walls 24. When each of the fluorescence layers 25 performs color display in the plasma display device, the fluorescence layer 25 is constituted by a red fluorescence layer 25R, a green fluorescence layer 25G and a blue fluorescence layer 25B, and the fluorescence layers 25R, 25G and 25B of these colors are provided in a predetermined order. FIG. 1 is a partially exploded perspective view, and in an actual embodiment, top portions of the separation walls 24 on the side of the second panel 20 are in contact with the protective film 15 on the side of the first panel 10. A discharge gas comprising a mixed gas, for example, of neon (Ne) and xenon (Xe) is sealed in each discharge space surrounded by adjacent separation walls 24, the fluorescence layer 25 and the protective film 15.

The extending direction of a projection image of the discharge sustaining electrode 12 and the extending direction of a projection image of the address electrode 22 cross each other at right angles, and a region where a pair of the discharge sustaining electrodes 12 and one combination of the fluorescence layers 25R, 25G and 25B for emitting light in three primary colors overlap corresponds to one pixel. Since glow discharge is caused between a pair of the discharge sustaining electrodes 12, such plasma display device of the above-described type is called as "surface discharge type". Further, a region where a pair of the discharge sustaining electrodes 12 and the address electrode 22 positioned between two separation walls 24 overlap corresponds to a discharge cell and, also, corresponds to a sub-pixel. That is, one discharge cell (one sub-pixel) is constituted by one fluorescence layer 25, a pair of discharge sustaining electrodes 12 and one address electrode 22.

In driving the plasma display device, for example, a pulse voltage lower than the discharge initiating voltage of the discharge cell is applied to the address electrode 22 immediately before the application of a voltage between a pair of the discharge sustaining electrodes 12. As a result, charges are accumulated in the dielectric layer 14 (selection of a discharge cell for display), and the apparent discharge initiating voltage decreases. Then, the discharge initiated between a pair of the discharge sustaining electrodes 12 can be sustained at a voltage lower than the discharge initiating voltage. In the discharge cell, the fluorescence layer 25 excited by irradiation of a vacuum ultraviolet ray generated by glow discharge in the discharge gas emits light in a color characteristic of a fluorescence material. Further, the vacuum ultraviolet ray having a wavelength according to a kind of the sealed discharge gas is generated.

Such plasma display device as described above starts to appear in the market. However, further reduction of power consumption is required and, to this end, a higher light emission efficiency is required in the plasma display device. Although it is possible to enhance the light emission efficiency by increasing a partial pressure of Xe gas of the discharge gas, when the partial pressure of the Xe gas is increased, a problem is caused in that driving voltage (discharge voltage) is increased or a time delay of discharge is increased.

In the plasma display device having a high partial pressure of Xe, as described above, the dielectric layer 14 is formed on the discharge sustaining electrode 12 in the first substrate 11, and the dielectric layer 14 is ordinarily formed by applying a glass paste, having a low melting point, which comprises, for example, PbO as a major component thereon by using a screen printing method and, then, sintering the thus applied glass paste. Then, the dielectric layer 14 comprising the glass paste having a low melting point comes to be one cause of the increase of the driving voltage or the increase of the time delay of discharge.

In order to decrease the driving voltage, the dielectric layer 14 is allowed to be thin. However, when the dielectric layer 14 comprising the glass paste having a low melting point is allowed to be thin, although the driving voltage is decreased, a problem is caused in that change of luminance along the passage of time becomes large. Further, since the dielectric layer 14 comprising the glass paste having a low melting point has a high specific inductive capacity and a large capacitance, a large amount of current flows, to thereby cause an increase of consumption of current of the plasma display device.

A method for forming the dielectric layer 14 comprising $SiO_X$ by using a chemical vapor deposition (CVD) method has been studied. Since the dielectric layer 14 comprising $SiO_X$ formed by using the chemical vapor deposition (CVD) method is as low as 4 in the specific inductive capacity and small in the capacitance, an amount of flowing current is small, to thereby realize the decrease of the consumption of current. Further, since $SiO_X$ is a dense film, a film thickness of the dielectric layer 14 can be thin, to thereby avoid the increase of the driving voltage. However, in the dielectric layer 14 comprising an ordinary $SiO_X$, the problem of the increase of the time delay of discharge has not been solved.

SUMMARY OF THE INVENTION

An object, therefore, of the present invention is to provide an alternating current driven type plasma display device which, without increasing a driving voltage (discharge voltage) and, also, without increasing the time delay of discharge, can realize a high efficiency and a low power consumption and, further, a method for producing the alternating current driven type plasma display device.

The stated object of the invention can be attained by an alternating current driven type plasma display device, comprising: a first panel comprising a plurality of first electrodes formed on a first substrate and a dielectric layer formed on the first substrate and the first electrodes; and a second panel, the first panel and the second panel being bonded to each other in circumferential portions thereof, wherein the dielectric layer is constituted by $SiO_x$; and wherein bonding density of $H_2O$ contained in $SiO_x$ is $3.0\times10^{20}$ Bonds/cm$^3$ or more.

Further, the stated object of the invention can be attained by a method for producing an alternating current driven type plasma display device comprising a first panel comprising a plurality of first electrodes formed on a first substrate and a dielectric layer formed on the first substrate and the first electrodes; and a second panel, in which the first panel and the second panel are bonded to each other in circumferential portions thereof, in which the dielectric layer is constituted by $SiO_X$ and in which bonding density of $H_2O$ contained in $SiO_X$ is $3.0\times10^{20}$ Bonds/cm$^3$ or more, wherein the dielectric layer is formed by a chemical vapor deposition method or a physical vapor deposition method.

In the alternating current driven type plasma display device or a production method for the alternating current driven type plasma display device according to the present invention (hereinafter, sometimes generally referred to simply as "present invention"), as a value of X in $SiO_x$, a relation of $1.0\leqq X\leqq 2.0$ can be illustrated.

According to the present invention, the dielectric layer can have a multi-layer constitution. In this case, it is required that an outermost surface layer of the dielectric layer having the multi-layer constitution is constituted by $SiO_X$ and bonding density of $H_2O$ contained in the outermost surface layer thereof is $3.0\times10^{20}$ Bonds/cm$^3$ or more. An under-layer of the dielectric layer having the multi-layer constitution can be constituted by, for example, a glass paste, having a low melting point, which comprises PbO as a major component, $SiO_Y$ which is not restricted by a value of the bonding density of $H_2O$ (for example, such $SiO_Y$ as being in a relation of $1.0\leqq Y\leqq 2.0$ and the bonding density of $H_2O$ therein being less than $3.0\times10^{20}$ Bonds/cm$^3$), aluminum oxide or a nitrogen compound. In this occasion, examples of such nitrogen compounds include $SiN_X$ and $SiO_XN_y$. The under-layer of the dielectric layer can have a mono-layer structure (monolayered under-layer structure) comprising one type of material selected from among these materials or a multi-layer structure (laminated under-layer structure) comprising a plurality of types of materials selected from among these materials.

According to the present invention, thickness of the dielectric layer is $5\times10^{-5}$ m or less and, preferably, $3\times10^{-5}$ m or less. On this occasion, the thickness of the dielectric layer is intended to indicate an average thickness of the dielectric layer on a plurality of first electrodes formed on the first substrate. When the dielectric layer is constituted by a single layer, as for a lower limit of the thickness of the dielectric layer, $1.0\times10^{-6}$ m can be mentioned. On the other hand, when the dielectric layer is constituted by a multiple of layers, as for a lower limit of the thickness of an uppermost surface layer comprising $SiO_X$ of the dielectric layer, $1.0\times10^{-8}$ m can be mentioned.

According to the present invention, it is not essential but preferable to form a protective film on the dielectric layer. When the protective film is formed thereon, the direct contact of an ion or an electron with the first electrode can be prevented and, as a result, wearing of the first electrode can be prevented. The protective film also functions as emitting a secondary electron necessary for discharge. As for materials constituting the protective film, magnesium oxide (MgO), magnesium fluoride ($MgF_2$) and calcium fluoride ($CaF_2$) can be mentioned. Among these materials, magnesium oxide is an appropriate material having such properties as a high emission ratio of the secondary electron, a chemical stability, a low sputtering ratio, a high light transmissivity at a wavelength of light emitted from the fluorescence layer and a low discharge initiating voltage. Further, the protective film may have a laminated-film structure comprising at least two materials selected from the group consisting of these materials.

The dielectric layer is formed based on a physical vapor deposition method (PVD method) or a chemical vapor deposition method (CVD method). Examples of such PVD methods, more specifically, include (a) various vacuum deposition methods such as an electron beam heating method, a resistance heating method and a flash deposition method;

(b) a plasma deposition method;

(c) various sputtering methods such as a bi-electrode sputtering method, a DC sputtering method, a DC magnetron sputtering method, a high-frequency sputtering method, a magnetron sputtering method, an ion-beam sputtering method and a bias sputtering method;

(d) various ion-plating methods such as a DC (direct current) method, an RF method, a multi-cathode method, an activation reaction method, an electric field deposition method, a high-frequency ion-plating method and a reactive ion plating method; and (e) a laser ablation method.

Further, examples of such CVD methods include an atmospheric pressure CVD method (APCVD method), a reduced pressure CVD method (LPCVD method), a low-temperature CVD method, a high-temperature CVD method, a plasma CVD method (PCVD method, PECVD method), an ECR plasma CVD method and a photo CVD method. Ordinarily, in forming the dielectric layer, the CVD method can more easily control an amount of bonding density of $H_2O$ contained in $SiO_X$ than the PVD method.

As for methods for forming the dielectric layer, in addition to the above-described examples, a screen printing method, a dry film method, a coating method (inclusive of spray coating method), a transfer method and a sol-gel method can be mentioned.

According to the present invention, the bonding density of $H_2O$ contained in $SiO_X$ can, based on a Fourier transform infrared spectroscopy (FT-IR), be determined by using a formula of Pliskin. That is, firstly, an $H_2O$ content W (unit: % by weight) in $SiO_X$ is, based on the formula (1) described below, determined. Further, "−14" and "89" in the formula (1) each indicate a coefficient.

$$W=-14\cdot I_{3650}+89\cdot I_{3330}\beta \quad (1)$$

On this occasion, $I_{3650}$ indicates an absorption intensity ($\mu m^{-1}$) at 3650 $cm^{-1}$; and $I_{3330}$ indicates an absorption intensity ($\mu m^{-1}$) at 3330 $cm^{-1}$.

Next, bonding density is, based on the formula (2) as described below, determined. Further, in the formula (2), "$7.35\times10^{20}$" indicates a coefficient.

$$H_2O\ (Bonds/cm^3)=W\times7.35\times10^{20} \quad (2)$$

In the alternating current driven type plasma display device according to the present invention, one discharge cell is constituted by a pair of the separation walls and the fluorescence layer (for example, any one fluorescence layer of a red fluorescence layer, a green fluorescence layer and a blue fluorescence layer) formed on the second substrate, and the first electrode and the second electrode which occupy a region surrounded by a pair of the separation walls. Then, the discharge gas is sealed in the discharge cell, more specifically, the discharge space surrounded by the separation walls and, then, the fluorescence layer emits light when irradiated by the vacuum ultraviolet ray generated by AC glow discharge which is performed in the discharge gas in the discharge space.

In the alternating current driven type plasma display device according to any one of various types of embodiments of the present invention, there may be employed a constitution in which one of a pair of the discharge sustaining electrodes is formed in the first panel as the first electrode and the other is formed in the second panel as the second electrode. The alternating current driven type plasma display device having such a constitution as described above will be called as "bi-electrode type" for convenience. In this case, a projection image of one discharge sustaining electrode extends in a first direction, the projection image of the other extends in a second direction different from the first direction, and a pair of the discharge sustaining electrodes are arranged such that one discharge sustaining electrode faces the other. In view of the structural simplification of the alternating current driven type plasma display device, the first direction and the second direction are preferably, but not necessarily, orthogonal to each other.

Alternatively, there may be employed a constitution in which a pair of the discharge sustaining electrodes are formed in the first panel as the first electrode and a so-called address electrode is formed in the second panel as the second electrode. The alternating current driven type plasma display device having such a constitution as described above will be referred to as "tri-electrode type" for convenience. In this case, there may be employed a constitution in which the projection images of a pair of the discharge sustaining electrodes extend in a first direction in parallel with each other, the projection image of the address electrode extends in a second direction and a pair of the discharge sustaining electrodes and the address electrode are arranged such that a pair of the discharge sustaining electrodes face the address electrode, although the constitution is not be limited thereto. In view of the structural simplification of the plasma display device, the first direction and the second direction are, preferably, but not necessarily, orthogonal to each other.

In the alternating current driven type plasma display device of tri-electrode type, a distance between a pair of the discharge sustaining electrodes is inherently arbitrary, so long as necessary glow discharge is generated at a predetermined discharge voltage. The distance, although being permissible to be approximately $1\times10^{-4}$ m, is less than $5\times10^{-5}$m and, preferably, less than $5.0\times10^{-5}$ m.

Further, according to the present invention, when a pair of the discharge sustaining electrodes are provided in the first panel as the first electrode, a discharge gap formed between edge portions of a pair of the discharge sustaining electrodes facing to each other may be in the form of a linear line. Alternatively, the form of the discharge gap may have a pattern bent or curved in the width direction of the discharge sustaining electrodes. In such arrangement as described above, an area in which portions of the discharge sustaining electrodes contribute to discharge can be increased. A pair of the discharge sustaining electrodes may be in the form of stripes extending up to an adjacent discharging cell or may be formed in a pair of wide stripes per discharge cell. In the latter case, a voltage is applied from a bus electrode to be described below to the discharge sustaining electrode. Further, in the latter case, since the first electrode is separately formed per discharge cell, it can be realized to decrease a current waste and, further decrease a current consumption, without decreasing brightness.

For example, the alternating current driven type plasma display device according to the present invention will be explained taking the alternating current driven type plasma display device of tri-electrode type as an example hereinafter. As far as the alternating current driven type plasma display device of bi-electrode type is concerned, "address electrode" corresponding to the second electrode in the explanation to be made below can be taken as "the other discharge sustaining electrode" as required.

The electrically conductive material constituting the discharge sustaining electrode corresponding to the first electrode differs depending upon whether the alternating current driven type plasma display device is a transmission type or a reflection type. In the alternating current driven type plasma display device of transmission type, since light emission from the fluorescence layers is observed through the second substrate, it is not a problem whether the electrically conductive material constituting the discharge sustaining electrode is transparent or non-transparent. However, since the address electrode is formed on the second substrate, the address electrode is required to be transparent. On the other hand, in the alternating current driven type plasma display device of reflection type, since light emission from the fluorescence layers is observed trough the first substrate, it is not a problem whether the electrically conductive material constituting the address electrode is transparent or non-transparent. However, the electrically conductive material constituting the discharge sustaining electrode is required to be transparent. The term "transparent or non-transparent" is based on the transmissivity of the electrically conductive material to light at a wavelength of emitted light (in visible light region) inherent to fluorescence materials. That is, when an electrically conductive material constituting the discharge sustaining electrode or the address electrode is transparent to light emitted from the fluorescence layers, it can be said that the electrically conductive material is transparent. Examples of such non-transparent electrically conductive materials include Ni, Al, Au, Ag, Pd/Ag, Cr, Ta, Cu, Ba, $LaB_6$ and $Ca_{0.2}La_{0.8}CrO_3$, and these materials may be used alone or in any combinations. Examples of such transparent electrically conductive materials include ITO (indium-tin oxide) and $SnO_2$. Any one of the discharge sustaining electrode and the address electrode can be formed by a sputtering method, a deposition method, a screen printing method, a sand blasting method, a plating method, a lift-off method or the like.

There may be employed a constitution in which, in addition to the discharge sustaining electrode, a bus electrode comprising a material having a lower electric resistivity than the discharge sustaining electrode is formed in contact with the discharge sustaining electrode for decreasing the impedance of the discharge sustaining electrode as a whole. The bus electrode can, typically, comprise a metal material such as Ag, Au, Al, Ni, Cu, Mo, Cr or a Cr/Cu/Cr stacked film. In the alternating current driven type plasma display device of reflection type, the bus electrode comprising the above-described metal material can be a factor to decrease a transmission quantity of visible light which is emitted from the fluorescence layers and passes through the first substrate and, then, to decrease the brightness of a display screen. It is, therefore, preferred to form the bus electrode to be as narrow as possible so long as an electric resistance value necessary for the discharge sustaining electrode as a whole can be obtained. The bus electrode can be formed by a sputtering method, a deposition method, a screen printing method, a sand blasting method, a plating method, a lift-off method or the like.

According to the present invention, examples of materials for constituting the first substrate for the first panel and the second substrate for the second panel include high-distortion-point glass, soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). The material for the first substrate and the material for the second substrate may be same to, or different from, each other. However, they are preferably same to each other in thermal expansion coefficient.

The fluorescence layer is constituted by a fluorescence material selected from the group consisting of a fluorescence material which emits light in red, a fluorescence material which emits light in green and a fluorescence material which emits light in blue. The fluorescence layer is formed on or above the address electrode. When the alternating current driven type plasma display device is for displaying in colors, specifically, the fluorescence layer constituted by a fluorescence material which emits light, for example, of a red color (red fluorescence layer) is formed on or above the address electrode, the fluorescence layer constituted by a fluorescence material which emits light, for example, of a green color (green fluorescence layer) is formed on or above another address electrode, and the fluorescence layer constituted by a fluorescence material which emits light, for example, of a blue color (blue fluorescence layer) is formed on or above still another address electrode. These three fluorescence layers for emitting light of three primary colors form one set, and such sets are formed in a predetermined order. A region where a pair of the discharge sustaining electrodes and one set of the fluorescence layers which emit light of three primary colors overlap corresponds to one pixel (comprising 3 sub-pixels). Each of the red fluorescence layer, the green fluorescence layer and the blue fluorescence layer may be formed in the form of a stripe, or may be formed in a lattice (waffle) state. Further, the fluorescence layers may be formed only on regions where the discharge sustaining electrodes and the address electrodes overlap.

As for the fluorescence materials for constituting the fluorescence layers, fluorescence materials which have a high quantum efficiency and cause less saturation to a vacuum ultraviolet ray can be selected from known fluorescence materials as required. When the plasma display device is assumed to be used as a color display, it is preferred to combine those fluorescence materials which have color purities close to three primary colors defined in NTSC, which give excellent white balance when three primary colors are mixed, which show a small afterglow time period and which can secure that the afterglow time periods of three primary colors are nearly equal. Examples of the fluorescence materials which emit light in red when irradiated by a vacuum ultraviolet ray include ($Y_2O_3$:Eu), ($YBO_3$Eu), ($YVO_4$:Eu), ($Y_{0.96}P_{0.60}V_{0.40}O_4$:$Eu_{0.04}$), [(Y,Gd)$BO_3$:Eu], ($GdBO_3$:Eu), ($ScBO_3$:Eu) and ($3.5MgO.0.5MgF_2.GeO_2$:Mn). Examples of the fluorescence materials which emit light in green when irradiated by a vacuum ultraviolet ray include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb) and ($Sr_4Si_3O_8Cl_4$:Eu). Examples of the fluorescence materials which emit light in blue when irradiated by a vacuum ultraviolet ray include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu) and ($Sr_2P_2O_7$:Sn). Examples of the methods for forming the fluorescence layers include a thick film printing method, a method in which fluorescence particles are sprayed, a method in which an adhesive substance is pre-applied to a region where the fluorescence layers are to be formed and fluorescence particles are allowed to adhere, a method in which a photosensitive fluorescence paste is provided and, then, a fluorescence layer is patterned by exposure and development, and a method in which a fluorescence layer is formed on the entire surface and unnecessary portions are removed by a sand blasting method.

The fluorescence layer may be formed directly on the address electrode or may be formed from on the address electrode to on the side walls of the separation wall. Otherwise, the fluorescence layer may be formed on the dielectric material layer provided on the address electrode or may be formed on the dielectric material layer formed from on the address electrode to on the side walls of the separation wall. Further, the fluorescence layer may be formed only on the side walls of the separation wall. Examples of the materials constituting the dielectric material layer include glass, having a low melting point, which comprises PbO as a major component and silicon oxide, and it can be formed by a screen printing method, a sputtering method or a vacuum deposition method. In some cases, a second protective film comprising magnesium oxide (MgO), magnesium fluoride ($MgF_2$) or calcium fluoride ($CaF_2$) may be formed on the fluorescence layer or on the surface of the separation wall.

Preferably, the separation walls (ribs) extending in parallel with the address electrodes are formed on the second substrate. As another case, a constitution in which a first separation wall extending in parallel with the address electrode and a second separation wall extending in parallel with the discharge sustaining electrode are formed on the second substrate (namely, a constitution in which the separation walls (ribs) are formed in a lattice state (waffle state)) is permissible. As still another case, the separation wall (rib) may have a meander structure. When the dielectric material layer is formed on the second substrate and on the address electrode, the separation wall may be formed on the dielectric material layer in some cases. The material constituting the separation wall can be selected from a known insulating material. For example, a mixture of widely used glass having a low melting point and a metal oxide such as alumina can be used. Height of the separation wall is approximately in the range of from 50 to 200 μm.

The separation wall can be formed by, for example, a screen printing method, a dry filming method, a photosensitive method or a sand blasting method. The above-described screen printing method refers to a method in which opening portions are formed in those portions of a screen which correspond to portions where the separation walls are to be formed, a separation-wall-forming material on the screen is passed through the opening portion with a squeeze to form a separation-wall-forming material layer on the second substrate or the dielectric material layer (these will be generically referred to as "second substrate or the like" hereinafter) and, then, the separation-wall-forming material layer is sintered. The above-described dry filming method refers to a method in which a photosensitive film is laminated on the second substrate or the like and, then, the photosensitive film in regions where the separation walls are to be formed is removed by exposure and development and, thereafter, opening portions formed by such removal are filled with a separation-wall-forming material and, subsequently, the separation-wall-forming material is sintered. The photosensitive film is combusted and removed by such sintering and, then, the separation-wall-forming material filled in the opening portions remains, to thereby constitute the separation walls. The above-described photosensitive method refers to a method in which a photosensitive material layer for forming the separation walls is formed on the second substrate or the like and, then, the photosensitive material layer is patterned by exposure and development and, thereafter, the thus-patterned photosensitive material layer is sintered. The above-described sand blasting method refers to a method in which a separation-wall-forming material layer is formed on the second substrate or the like, for example, by screen printing or with a roll coater, a doctor blade or a nozzle-ejecting coater and is dried and, then, those portions where the separation walls are to be formed in the separation-wall-forming material layer are masked with a mask layer and exposed portions of the separation-wall-forming material layer are removed by a sand blasting method. The separation walls may be formed in black to form a so-called black matrix. In this case, a high contrast of the display screen can be attained. As for a method of forming the black separation walls, a method in which the separation walls are formed by using a color resist material colored in black can be illustrated.

According to the present invention, it is desirable that a pressure of a rare gas sealed in the discharge space is in the range of from $1\times10^2$ Pa to $5\times10^5$ Pa and, preferably, in the range of from $1\times10^3$ Pa to $4\times10^5$ Pa. When the distance between a pair of the discharge sustaining electrodes is less than $5\times10^{-5}$ m, it is desirable that the pressure of the rare gas is in the range of from $1\times10^2$ Pa to $3\times10^5$ Pa, preferably in the range of from $1\times10^3$ Pa to $2\times10^5$ Pa and, more preferably, in the range of from $1\times10^4$ Pa to $1\times10^5$ Pa. When the pressure of the rare gas is adjusted to the above-described pressure range, the fluorescence layer emits light when irradiated by a vacuum ultraviolet ray generated mainly on the basis of cathode glow in the rare gas. With an increase in pressure in the above pressure range, the sputtering ratio of various members constituting the alternating current driven type plasma display device decreases, which results in an increase in the lifetime of the plasma display device.

In the rare gas to be sealed in the discharge space, requirements (1) to (4) to be described below are to be satisfied. Examples of such rare gases include He (wavelength of resonance line=58.4 nm), Ne (ditto=74.4 nm), Ar (ditto=107 nm), Kr (ditto=124 nm) and Xe (ditto=147 nm). While these rare gases may be used alone or as a mixture, mixed gases which can expect a decrease in the discharge initiating voltage based on a Penning effect are useful. Examples of the mixed gases include Ne—Ar mixed gases, He—Xe mixed gases, Ne—Xe mixed gases, He—Kr mixed gases, Ne—Kr mixed gases and Xe—Kr mixed gases. Among these rare gases, particularly, Xe having a longest resonance line wavelength is favorable since it also radiates an intense vacuum ultraviolet ray even at a wavelength of 172 nm of a molecular line.

(1) The rare gas is chemically stable and permits setting of a high gas pressure from the viewpoint of attaining a longer lifetime of the alternating current driven type plasma display device.

(2) The rare gas permits the high radiation intensity of a vacuum ultraviolet ray from the viewpoint of attaining higher brightness of a display screen.

(3) A vacuum ultraviolet ray to be radiated has a long wavelength from the viewpoint of increasing and energy conversion efficiency from a vacuum ultraviolet ray to visible light.

(4) The discharge initiating voltage is low from the viewpoint of decreasing power consumption.

According to the present invention, even when the Xe partial pressure is allowed to be high, compared with a conventional alternating current driven type plasma display device, since the bonding density of $H_2O$ contained in $SiO_X$ constituting the dielectric layer is $3.0\times10^{20}$ Bonds/cm$^3$ or more, $H_2O$ in the dielectric layer assists discharge and, as a result, the time delay of discharge can be shortened. Further, since the dielectric layer can be thin by being constituted by $SiO_X$, a decrease of the driving voltage (discharge initiating voltage and discharge sustaining voltage) of the alternating current driven type plasma display device can be attained. As a result, discharge stability is enhanced, reliability of the alternating current driven type plasma display device is enhanced and, then, it becomes possible to obtain the alternating current driven type plasma display device which performs a display having a higher fineness. Further, since the dielectric layer is constituted by $SiO_X$, the capacitance of the dielectric layer can be reduced and, as a result, an amount of the current flowing in the dielectric layer can be reduced and, therefore, a high efficiency, namely, reduction of power consumption of the alternating current driven type plasma display device can be attained.

Further, in the alternating current driven type plasma display device according to the present invention, by providing a uniform homogeneous dielectric layer, a direct contact of an ion or an electron with the first electrode can be prevented and, as a result, wearing of the first electrode can be prevented. Still further, the dielectric layer not only has a function of storing a wall charge but also has a function as a resistive element which controls an excess discharge current and a memory function for sustaining a discharge state.

DESCRIPTION OF THE PREFERRED EMBODIMENTS

Hereinafter, the present invention is described with reference to drawings.

EXAMPLE 1

Example 1 relates to an alternating current driven type plasma display device according to the present invention (hereinafter, referred to also as "plasma display device" for short) and a production method therefor.

Figure 1:
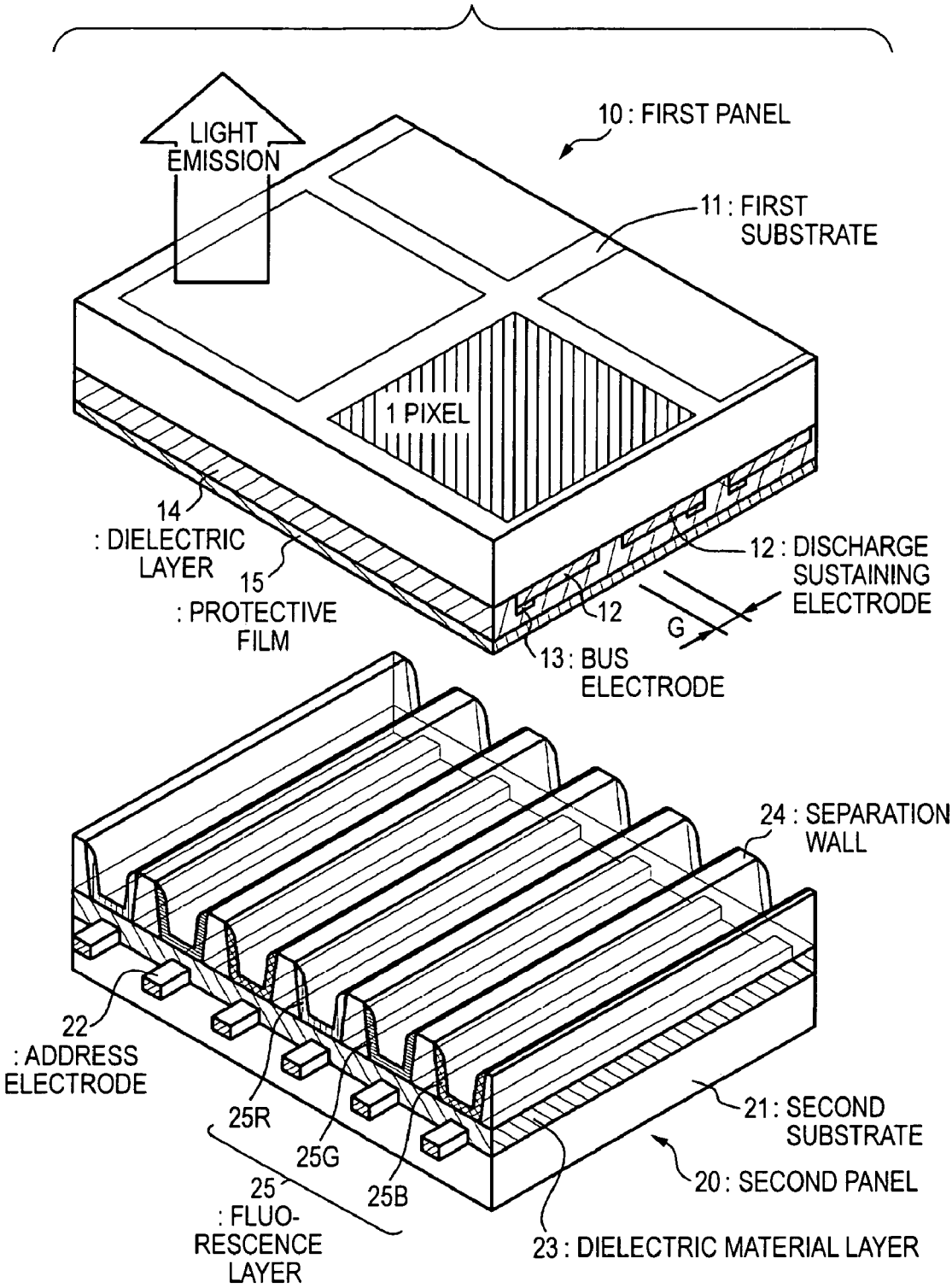
FIG. 1 is a schematic exploded perspective view of a portion of a constitutional example of an alternating current driven type plasma display device of tri-electrode type.

The plasma display device of Example 1, being a plasma display device of tri-electrode type, comprises a first panel 10 comprising a plurality of first electrodes 12 formed on a first substrate 11 and a dielectric layer 14 formed on the first substrate 11 and the first electrodes 12 and a second panel 20, in which the first panel 10 and the second panel 20 are bonded to each other in circumferential portions thereof. On this occasion, a schematic exploded perspective view of the plasma display device of Example 1 is same as that shown in FIG. 1. Since constitution and structure of this plasma display device are same as those of the plasma display device as described in "BACKGROUND OF THE INVENTION", detailed description is omitted. Hereinafter, difference from the plasma display device as described in "BACKGROUND OF THE INVENTION" is described.

The plasma display device of Example 1 has a characteristic feature in that a dielectric material layer 14, being constituted by a monolayer of $SiO_X$ (actual measurement of X being approximately 1.9), is formed by a CVD method. Bonding density of $H_2O$ contained in $SiO_X$ is allowed to be $3.0\times10^{20}$ Bonds/cm$^3$ or more.

Hereinafter, a method for producing a plasma display device of Example 1 is described.

A first panel 10 can be produced by a method as described below. Namely, firstly, an ITO layer was formed on an entire face of a first substrate 11 comprising glass having a high distortion point or soda glass by, for example, a sputtering method and, then, the thus-formed ITO layer was patterned in the form of stripes by photolithography and etching, to thereby form a plurality of pairs of discharge sustaining electrodes 12 corresponding to first electrodes. The discharge sustaining electrodes 12 extend in a first direction. Next, a chromium film, an aluminum film, a copper film or the like was formed on the entire face by, for example, a deposition method and, then, the thus-formed chromium film, aluminum film, copper film or the like was patterned by photolithography and etching, to thereby form bus electrodes 13 along the edge portions of the discharge sustaining electrodes 12. A gap formed between a pair of dielectric electrodes 12 (shown as discharge gap "G" in FIG. 1) was allowed to be $4\times10^{-5}$ m (40 μm).

Thereafter, a dielectric layer 14 comprising $SiO_X$ was formed on the entire face thereof by the CVD method under conditions as shown in Table 1. An average thickness of the dielectric layer 14 on the discharge sustaining electrodes 12 was allowed to be 14 μm.

Subsequently, a protective film 15, comprising magnesium oxide (MgO), which has a thickness of 0.6 μm was formed on the dielectric layer 14 by an electron beam deposition method. By performing the above-described steps, the first panel 10 can be completed.

A second panel 20 can be produced by a method to be described below. Namely, firstly, a silver paste was printed on a second substrate 21 comprising glass having a high distortion point or soda glass by, for example, a screen printing method such that the silver paste had the form of stripes and, then, the thus-printed silver paste was sintered, to thereby form address electrodes 22. The address electrodes 22 extend in a second direction which crosses the first direction at right angles. Next, a glass paste layer, having a low melting point, which comprises PbO as a major component was formed on an entire face thereof by a screen printing method and, then, the glass paste layer having the low melting point was sintered, to thereby form a dielectric material layer 23. Then, a glass paste having a low melting point was printed on the dielectric material layer 23 on and above a region between adjacent address electrodes 22 by, for example, a screen printing method and, thereafter, sintered (for about 2 hours at about 560° C.), to thereby form separation walls 24. An average height of the separation walls 24 was allowed to be 130 μm. Subsequently, fluorescence material slurries of three primary colors were consecutively printed and sintered, to thereby form each of fluorescence layers 25R, 25G and 25B from on the dielectric material layer 23 between separation walls 24 to on the side walls of separation walls 24. By performing the above-described steps, the second panel 20 can be completed.

Next, a plasma display device was assembled. That is, firstly, a frit glass layer (seal layer) was formed on a circumferential portion of the second panel 20 by using frit dispense. Then, the first panel 10 and the second panel 20 were bonded to each other and, thereafter, sintered, to thereby cure the frit glass layer. Subsequently, a space formed between the first panel 10 and the second panel 20 was vacuumed, charged with, for example, a discharge gas (comprising 100% of Xe with a pressure of $3\times10^4$ Pa) and sealed, to thereby complete the plasma display device.

The discharge initiating voltage and the discharge sustaining voltage and, also, time of 99.99% discharge probability which is an indicator of a time delay of discharge of the thus-completed plasma display device were measured. The results of such measurements are shown in Table 1.

Further, an $SiO_X$ film having a thickness of 14 μm was formed on a silicon semiconductor substrate under same conditions as in forming the dielectric layer 14 of Example 1. The bonding density of $H_2O$ contained in the $SiO_X$ film was, based on Fourier transform infrared spectroscopy (FT-IR), determined by using the formulas (1) and (2) as previously described. The results are shown in Table 1. A background measurement was determined by measuring a silicon semiconductor substrate in which nothing has been formed on a surface. Further, as for a transmission type FT-IR measuring apparatus, an apparatus available from Bio-Rad Laboratories, Inc. under the trade name of FTS-575C was used.

Still further, an $SiO_X$ film having a thickness of 14 μm was formed on a silicon semiconductor substrate under same conditions as in forming the dielectric layer 14 of Example 1. A dry etching speed and a wet etching speed of the thus-formed $SiO_X$ film were measured. In the dry etching, an $NF_3$ gas of 1000 sccm was used with a microwave power of 3 kW being applied, while, in the wet etching, an etchant of $NH_4F$:HF=6:1 was used. The dry etching speed was measured also in Comparative Example 1 and Example 5 and the wet etching speed was measured also in Comparative Example 1. The results of such measurements are shown in Tables 1 and 2.

TABLE 1

| | | Forming method: CVD method | | | | | |
|---|---|---|---|---|---|---|---|
| | | Example | | | | Comparative Example | |
| | Unit | 1 | 2 | 3 | 4 | 1 | 2 |
| Process gas | | | | | | | |
| $SiH_4$ | sccm | 450 to 600 | 450 to 600 | 450 to 600 | 450 to 600 | 200 to 330 | 100 to 200 |
| $N_2O$ | sccm | 7000 | 7000 | 7000 | 7000 | 8000 | 6000 |
| Gas pressure | Pa | 200 | 200 | 200 | 200 | 266 | 200 |
| RF power | W | 1600 | 1600 | 1000 | 1600 | 2000 | 1000 |
| First substrate temperature | ° C. | 320 | 390 | 320 | 250 | 320 | 320 |
| $H_2O$ amount | $\times 10^{20}$ Bonds/cm$^3$ | 9.5 | 3.0 | 10.0 | 13.0 | Below measurable limit | |
| Discharge initiating voltage | Volt | 240 | 260 | 240 | 230 | 280 | 270 |
| Discharge sustaining voltage | Volt | 180 | 185 | 180 | 180 | 200 | 190 |
| Time of 99.99% discharge probability | microsecond | 1.05 | 1.30 | 1.10 | 1.00 | 6.50 | 3.50 |
| Dry etching speed | μm/min. | 0.3 | — | — | — | 0.23 | — |
| Wet etching speed | μm/min. | 0.3 | — | — | — | 0.2 | — |

EXAMPLES 2 TO 4; AND COMPARATIVE EXAMPLES 1 AND 2

A dielectric layer 14 comprising $SiO_X$ was formed under same conditions as in Example 1 except for using a CVD method in conditions as shown in Table 1. Further, an $SiO_X$ film having a thickness of 14 μm was formed on a silicon semiconductor substrate in a same manner as in Example 1. The bonding density of $H_2O$ contained in the $SiO_X$ film was, based on Fourier transform infrared spectroscopy (FT-IR), determined by using the formulas (1) and (2) as previously described.

The discharge initiating voltage and the discharge sustaining voltage and, also, the discharge probability of the thus-completed plasma display device were measured. The results of such measurements are shown in Table 1.

EXAMPLE 5 AND COMPARATIVE EXAMPLE 3

A dielectric layer 14 comprising $SiO_X$ was formed in a same manner as in Example 1 except for using a PVD method under conditions as shown in Table 2 (specifically, sputtering method) Further, an $SiO_X$ film having a thickness of 14 μm was formed on a silicon semiconductor substrate in a same manner as in Example 1. The bonding density of $H_2O$ contained in the $SiO_X$ film was, based on Fourier transform infrared spectroscopy (FT-IR), determined by using the formulas (1) and (2) as previously described.

The discharge initiating voltage and the discharge sustaining voltage and, also, the discharge probability of the thus-completed plasma display device were measured. The results of such measurements are shown in Table 2.

TABLE 2

| | Forming method: Sputtering method | | |
|---|---|---|---|
| | Unit | Example 5 | Comparative Example 3 |
| Target | | $SiO_2$ | $SiO_2$ |
| Process gas | | | |
| $N_2$ | sccm | 300 | 240 |
| $O_2$ | sccm | | 60 |
| Gas pressure | Pa | 0.3 | 0.3 |
| RF power | W | 1500 | 900 |
| First substrate temperature | ° C. | room temperature | room temperature |
| $H_2O$ amount | $\times 10^{20}$ Bonds/cm$^3$ | 13.0 | Below measurable limit |
| Discharge initiating voltage | Volt | 250 | 300 |
| Discharge sustaining voltage | Volt | 180 | 230 |
| Time of 99.99% discharge probability | microsecond | 1.25 | 9.00 |
| Dry etching speed | μm/min. | 0.6 | — |

From the results as shown in Tables 1 and 2, it is found that decrease of the discharge initiating voltage and the discharge sustaining voltage and shortening of time of 99.99% discharge probability which is an indicator of a time delay of discharge can be attained, so long as a value of the bonding density of $H_2O$ contained in the $SiO_X$ film is $3.0\times10^{20}$ Bonds/cm$^3$ or more. Further, from comparisons of etching speeds of the $SiO_X$ films among Example 1, Example 5 and Comparative Example 1, it is found that, as the value of the bonding density of $H_2O$ contained in the $SiO_X$ film is higher, the etching speed becomes higher, that is, the film tends to be less dense.

The present invention has been explained with reference to embodiments; however, the present invention shall not be limited thereto. The structures and constitutions of the plasma display devices, the materials, the dimensions and the production methods used or explained in Examples are provided for illustration purposes and can be changed or altered as required and the production methods for the dielectric layers used or explained in Examples are provided for illustration purposes and can be changed or altered as required.

The present invention can be applied to the plasma display device of transmission type in which light emission from fluorescence layers is observed through the second substrate. In the plasma display device of transmission type, since the light emission from the fluorescence layers is observed through the second substrate, it is not a problem whether the electrically conductive material constituting the discharge sustaining electrode is transparent or non-transparent. However, since the address electrode is formed on the second substrate, it is advantageous from the standpoint of brightness of the display to allow the address electrode to be transparent.

Examples have employed a constitution in which the plasma display device comprises a pair of the discharge sustaining electrodes extending in parallel with each other. However, this constitution can be replaced by a constitution in which a pair of bus electrodes extend in a first direction, one discharge sustaining electrode extends in a second direction from one bus electrode short of the other bus electrode between a pair of the bus electrodes and the other discharge sustaining electrode extends in the second direction from the other bus electrode short of the one bus electrode between a pair of the bus electrodes. There may be employed a constitution in which, of a pair of the discharge sustaining electrodes, one discharge sustaining electrode extending in the first direction is formed on the first substrate and the other discharge sustaining electrode is formed on an upper portion of a side wall of the separation wall 24 so as to be in parallel with the address electrode. The plasma display device of the present invention may be a bi-electrode type plasma display device. Further, the address electrode may be formed on the first substrate. The thus-structured alternating current driven type plasma display device can comprise, for example, a pair of discharge sustaining electrodes extending in the first direction and an address electrode formed near and along one of a pair of the discharge sustaining electrodes (provided that the address electrode extending along one of a pair of the discharge sustaining electrodes has a length which does not exceed the length of a discharge cell extending along the first direction). Short-circuiting to the discharge sustaining electrode is prevented by a structure in which a wiring for the address electrode is formed through an insulating layer, the wiring extends in the second direction, and the wiring for the address electrode and the address electrode are electrically connected or the address electrode extends from the wiring for the address electrode.

Figure 2:
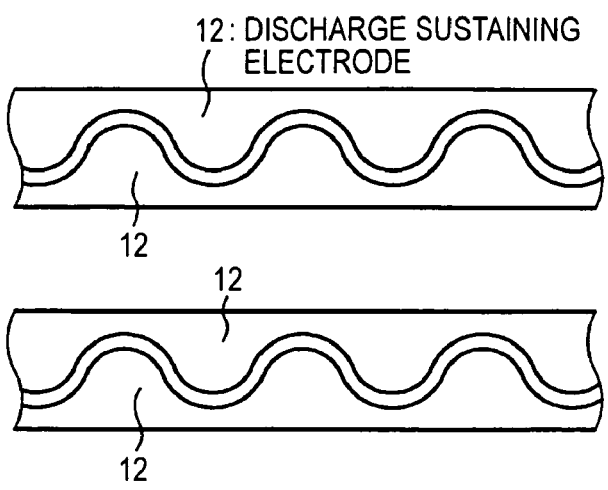
FIG. 2(*a*), 2(*b*) and 2(*c*) is a schematic partial plan view of a pair of discharge sustaining electrodes when a shape of a discharge gap formed between edge portions facing to each other of a pair of discharge sustaining electrodes is allowed to be in a pattern bent or curved in a width direction of the discharge sustaining electrodes in the plasma display device according to the present invention.
Figure 2:
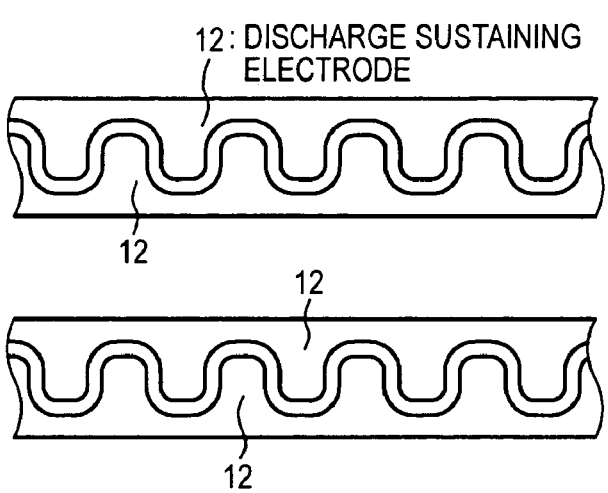
Figure 2:
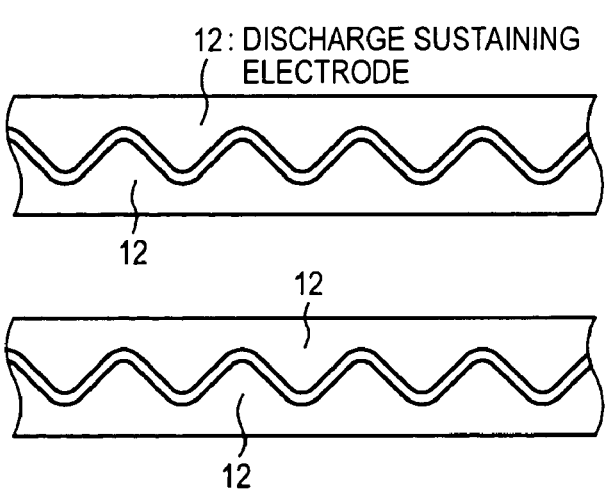

In Examples, the discharge gap formed by edge portions of a pair of the discharge sustaining electrodes facing to each other has the form of a straight line. However, the discharge gap formed by the edge portions of a pair of the discharge sustaining electrodes facing to each other may have the form of a pattern bent or curved in the width direction of the discharge sustaining electrodes (for example, a combination of any forms such as the forms of a "dogleg", an "S-letter" and an "arc"). In such a constitution, the length of each of the edge portions of a pair of the discharge sustaining electrodes facing to each other can be increased and, accordingly, the discharge efficiency can be improved. FIGS. 2A, 2B and 2C show schematic partial plan views of two sets of a pair of discharge sustaining electrodes having the above structures.

In Examples, although the separation walls (ribs) 24 extending in nearly parallel to the address electrodes 22 were allowed to have the form of stripes, the separation walls (ribs) 24 may have a meander structure, the form of lattice (waffle) or other structures. Further, the separation walls 24 may be formed in black to function as a so-called black matrix. In this case, a high contrast of the display screen can be realized.

One example of an alternating current glow discharge operation of the plasma display device according to the present invention will be explained below. Firstly, a pulse voltage higher than a discharge initiating voltage $V_{bd}$ is applied to all of respective ones of pairs of the discharge sustaining electrodes 12 (discharge sustaining electrodes on a common side) for a short period of time. By such application of the pulse voltage, glow discharge is generated to cause a wall charge on a surface of the dielectric layer 14 in the vicinity of a pair of the discharge sustaining electrodes 12 due to dielectric polarization and, then, thus-caused wall charge is accumulated, to thereby decrease an apparent discharge initiating voltage. Thereafter, while a voltage is continuously applied to the address electrode 22, a voltage is applied to one of a pair of the discharge sustaining electrodes 12 contained in a discharge cell which is not allowed to display (discharge sustaining electrodes on a scanning side) and, accordingly, glow discharge is generated between the address electrode 22 and one of a pair of the discharge sustaining electrodes 12 (discharge sustaining electrodes on the scanning side), to thereby erase the accumulated wall charge. Such erasure of discharge is consecutively executed in the address electrodes 22. On the other hand, no voltage is applied to one of a pair of the discharge sustaining electrodes contained in the discharge cell which is allowed to display and, accordingly, the accumulated wall charge is retained. Then, a predetermined pulse voltage is applied between all of the pairs of the discharge sustaining electrodes 12. As a result, in the discharge cell in which the wall charge is accumulated, glow discharge starts between a pair of the discharge sustaining electrodes 12 and, in the discharge cell, the fluorescence layer excited by irradiation of a vacuum ultraviolet ray generated by glow discharge in a discharge gas in the discharge space emits light in color characteristic of the kind of a fluorescence material. Further, a phase of the discharge sustaining voltage applied to one of the discharge sustaining electrodes and a phase of the discharge sustaining voltage applied to the other discharge sustaining electrode deviate from each other by half a cycle, and the polarity of each discharge sustaining electrode is inverted according to the frequency of alternating current.

Another example of the alternating current glow discharge operation of the plasma display device according to the present invention will be explained below. Firstly, erasure of discharge is executed to all of pixels for initializing all of the pixels and, then, a discharge operation is performed. The discharge operation is divided into an address period in which a wall charge is generated on a surface of the dielectric layer by an initial discharge and a discharge sustaining period in which the glow discharge is sustained. In the address period, a pulse voltage lower than the discharge initiating voltage $V_{bd}$ is applied to one of the discharge sustaining electrodes which is selected and an address electrode 22 which is selected for a short period of time. A region where one of the discharge sustaining electrodes which is applied with the pulse voltage and the address electrode which is applied with the pulse voltage overlap is selected as a display pixel and, then, in the thus-overlapped region, a wall charge is generated on a surface of the dielectric layer due to dielectric polarization and, accordingly, the wall charge is accumulated. In the succeeding discharge sustaining period, a discharge sustaining voltage $V_{SUS}$ lower than $V_{bd}$ is applied to a pair of the discharge sustaining electrodes. When a sum of the wall voltage $V_W$ induced by the wall charge and the discharge sustaining voltage $V_{SUS}$ comes to be greater than the discharge initiating voltage $V_{bd}$, (namely, $V_W+V_{SUS}>V_{bd}$), glow discharge is initiated. A phase of the discharge sustaining voltages $V_{SUS}$ applied to one of the discharge sustaining electrodes and a phase of the discharge sustaining voltages $V_{SUS}$ applied to the other of the discharge sustaining electrodes deviate from each other by half a cycle, and the polarity of the discharge sustaining electrode is inverted in accordance with a frequency of alternating current.

What is claimed is:

1. An alternating current driven type plasma display device, comprising:

a first panel comprising a plurality of first electrodes formed on a first substrate and a dielectric layer formed on the first substrate and the first electrodes; and a second panel, the first panel and the second panel being bonded to each other in circumferential portions thereof, wherein the dielectric layer is constituted by $SiO_x$; and wherein bonding density of $H_2O$ contained in $SiO_x$ is $3.0\times10^{20}$ Bonds/cm$^3$ or more.

2. The alternating current driven type plasma display device according to claim 1, wherein thickness of the dielectric layer is $5\times10^{-5}$ m or less.

3. The alternating current driven type plasma display device according to claim 1, wherein a protective film is formed on a surface of the dielectric layer.

4. A method for producing an alternating current driven type plasma display device comprising a first panel comprising a plurality of first electrodes formed on a first substrate and a dielectric layer formed on the first substrate and the first electrodes; and a second panel, in which the first panel and the second panel are bonded to each other in circumferential portions thereof, in which the dielectric layer is constituted by $SiO_x$ and in which bonding density of $H_2O$ contained in $SiO_x$ is $3.0\times10^{20}$ Bonds/cm$^3$ or more, wherein the dielectric layer is formed by a chemical vapor deposition method or a physical vapor deposition method.

* * * * *